US005405025A

United States Patent [19]

Melrose

[11] Patent Number: 5,405,025

[45] Date of Patent: Apr. 11, 1995

[54] ADJUSTABLE SOCKET TRAY

[75] Inventor: David R. Melrose, Ringoes, N.J.

[73] Assignee: Ingersoll-Rand Company, Woodcliff Lake, N.J.

[21] Appl. No.: 201,967

[22] Filed: Feb. 25, 1994

[51] Int. Cl.[6] ..... A47F 7/00

[52] U.S. Cl. ..... 211/70.6; 211/13; 206/378

[58] Field of Search ..... 211/70.6, 13, 1.51, 211/184, 175, 89; 206/378; 29/568

[56] References Cited

U.S. PATENT DOCUMENTS

| | | | |
|---|---|---|---|
| 3,604,565 | 9/1971 | Freeman | 211/60 |
| 3,762,568 | 10/1973 | Dimitrov et al. | 211/1.5 |
| 3,819,058 | 6/1974 | Reis | 211/70.6 |
| 4,087,901 | 5/1978 | Lohneis et al. | 29/568 |
| 4,107,589 | 8/1978 | Eto et al. | 318/602 |
| 4,155,460 | 5/1979 | Ratti | 211/60 T |
| 4,337,860 | 7/1982 | Carrigan | 211/70.6 X |
| 4,353,465 | 10/1982 | Rado | 211/70.6 X |
| 4,359,163 | 11/1982 | Ratti | 211/70.6 |
| 4,452,361 | 6/1984 | Harris | 211/60 T |
| 4,530,148 | 7/1985 | Flamme et al. | 29/568 |
| 4,621,738 | 11/1986 | DeLucchi | 211/70.6 |
| 4,649,610 | 3/1987 | Onishi et al. | 29/26 A |
| 4,654,954 | 4/1987 | Bayes et al. | 29/568 |
| 4,922,603 | 5/1990 | Kosmowski | 29/568 |
| 4,941,577 | 7/1990 | Ferree et al. | 211/70.6 |
| 5,033,183 | 7/1991 | Morisaki | 29/568 |
| 5,080,230 | 1/1992 | Winnard | 206/350 |
| 5,111,573 | 5/1992 | Ito et al. | 483/1 |
| 5,165,629 | 11/1992 | Breveglieri | 248/110 |
| 5,195,636 | 3/1993 | Wridt | 206/378 |
| 5,228,570 | 7/1993 | Robinson | 211/70.6 X |
| 5,284,245 | 2/1994 | Slivon | 211/70.6 X |
| 5,316,143 | 5/1994 | Horn | 211/70.6 X |

*Primary Examiner*—Ramon O. Ramirez
*Assistant Examiner*—Sarah L. Purol
*Attorney, Agent, or Firm*—Walter C. Vliet

[57] ABSTRACT

An adjustable socket tray for use in assembly operations wherein the tray is provided with movable partitions to selectively store sockets of different diameter and effect notification to a controller of a selected socket for establishing appropriate conditions of fastener tightening via the socket selection process.

9 Claims, 1 Drawing Sheet

ADJUSTABLE SOCKET TRAY

BACKGROUND OF THE INVENTION

This invention relates generally to selected assistance storage devices and more particularly to a storage tray for fastener driving sockets and the like wherein socket selection coordinates the selection with an appropriate driving force output for the socket driving tool. The selection of driving output or applied torque is important in assembly operations and the like where different size fasteners are often encountered and overdrive of the fastener is likely to cause damage both to the fastener and its mating parts.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention this is accomplished by providing an adjustable socket tray comprising a tray for visually displaying and supporting two or more sockets; a plurality of movable partitions for adjustably supporting the sockets in close proximity about a centerline on the tray; means for detecting the presence of the sockets in the tray; and means for determining a condition response in response to the detected presence of the sockets.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
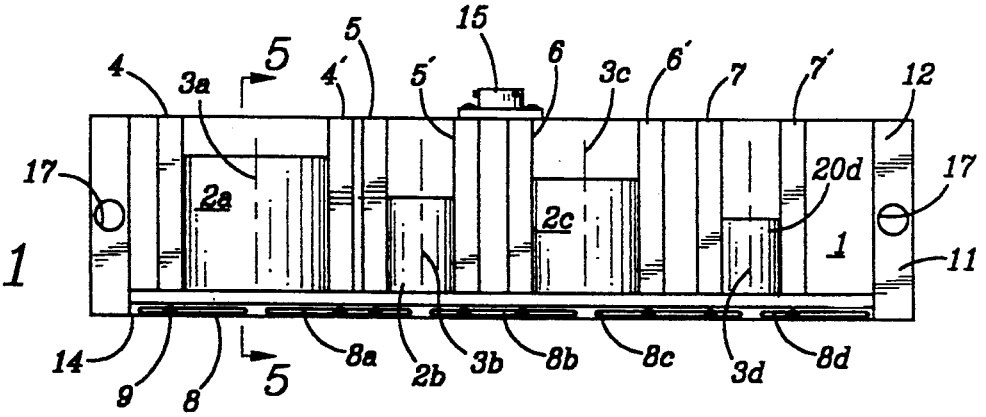
FIG. 1 is a plan view of one embodiment of the present invention adapted for horizontal support on a workbench or the like showing the sockets in place.

Referring to FIG. 1, an adjustable socket tray according to the present invention is shown and generally designated by the reference numeral 1. The socket tray is provided with eight partitions, in pairs, 4, 4'; 5, 5'; 6, 6'; and 7, 7', for adjustable support of sockets 2*a*, 2*b*, 2*c*, and 2*d*, respectively, about centerlines 3*a*, 3*b*, 3*c*, and 3*d*. The bottom of the socket is supported by a rest 14 which is further provided with five elongated slots 8, 8*a*, 8*b*, 8*c*, and 8*d*. The partitions 4 et seq. are attached to the rest by means of securing screws 9 disposed within the slots.

Figure 4:
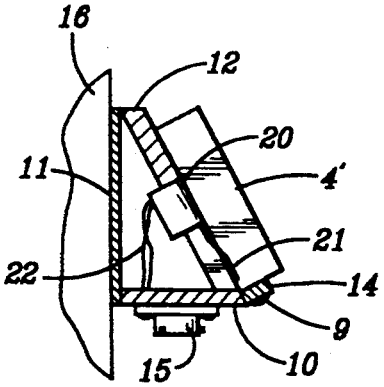
FIG. 4 is a cross sectional view taken at Section 4—4 of FIG. 2.
Figure 5:
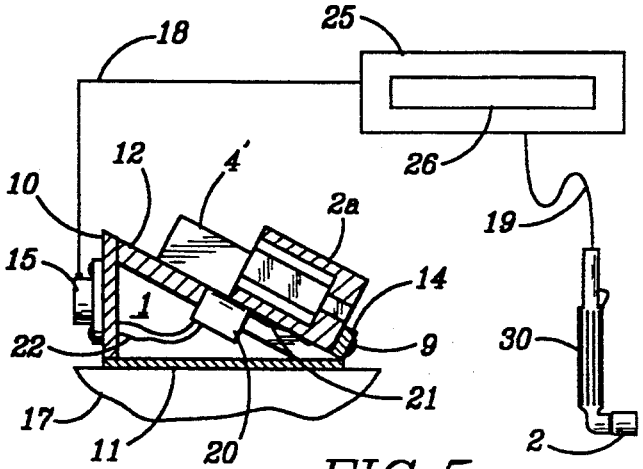
FIG. 5 is a cross sectional view taken at Section 5—5 of FIG. 1 and shows the schematic representation of a decision device and tool utilizing the sockets stored on the tray.

It should be appreciated that once the screws 9 are loosened, the partitions are free to move along the slots to adjust the gap between the partitions to a desired socket diameter selected about the centerlines 3*a* et seq. The selected position of the partitions are secured by tightening the screw. Positioned support of the sockets are thereby obtained between the rest 14, the adjusted movable partitions, and the tray faceplate 12. A mounting or backing plate 11 is provided to secure the adjustable tray to a wall 16, for example, in the vertical position, as shown in FIG. 4, or a workbench 17 or the like in a horizontal position, as shown in FIG. 5. The mounting plate 11 is provided with a plurality of perforations 17 for purpose of accommodating mounting fasteners.

The configuration of the socket tray also includes a base 10 which provides elevation to the faceplate 12 to present the sockets in a more readily selectable and secured position as shown in both FIGS. 4 and 5. The base 10 also provides a ready mounting surface for a connector 15 which serves as an interface connector between a controller or computer 25 as depicted in FIG. 5. The controller controls the power and rotational output (for example torque) of a power tool 30 (for example) having its output on a socket 2 which engages a fastener to be tightened (not shown). In addition to controlling the output of the tool 30 the computer/controller 25 may issue commands via a display 26.

Figure 2:
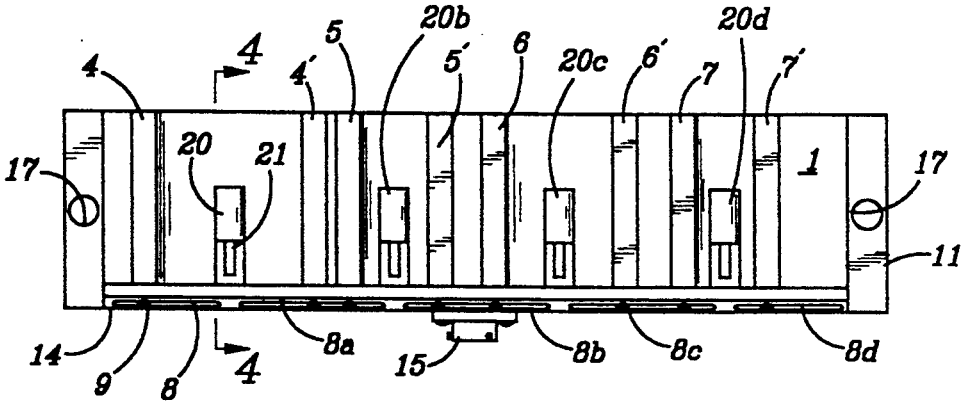
FIG. 2 is a front elevation view of a socket tray according to the present invention adapted for wall mounting showing the sockets removed.
Figure 3:
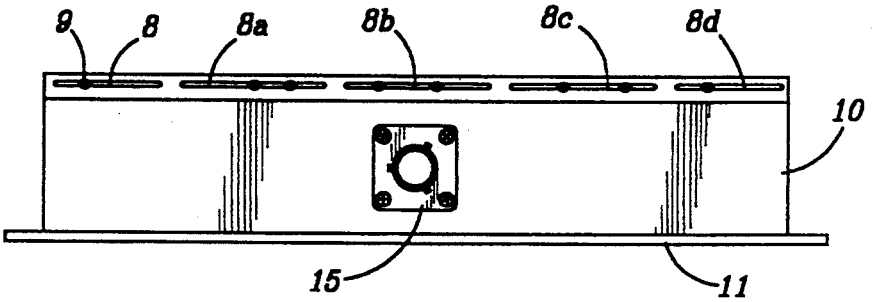
FIG. 3 is a bottom view of the FIG. 2 embodiment.

According to the present invention, a sensing switch or microswitch 20 is positioned along the respective socket centerline position, as best seen in FIGS. 2, 4 and 5. A switch activator 21 contacts the socket when it is disposed within the confines of the socket tray to provide an indication of the presence of the socket. This information is transmitted via wires 22 to the connector 15 and in turn via the cable 18 to the computer/controller 25. The controller output is transmitted to the power tool 30 by means of a power cable 19.

In operation, an operator may select a socket from any position, for example, socket 2*a*. Microswitch 20*a* will sense the selection as the socket 2*a* looses contact with the switch actuator 21 of switch 20*a*. This information is transmitted to the controller and a decision is made with regard to the appropriate torque output of the tool for the selected socket. The display 26 may provide an appropriate command to the operator to tighten an identified fastener with the combination.

It should be appreciated by one skilled in the art that this provides a simplified selection and control system for fastener tightening as well as adjustable and selective storing of appropriate sockets for use in assembly operations and the like.

Having described my invention in terms of a preferred embodiment, I do not wish to be restricted in the scope of my invention except as claimed.

What is claimed is:

1. An adjustable socket tray comprising:

a tray for visually displaying and supporting two or more sockets;

a plurality of movable partitions for adjustably supporting said sockets in close proximity about a centerline on said tray;

means for detecting the presence of said sockets in said tray; and means for determining a condition response in response to the detected presence of said sockets.

2. An adjustable socket tray according to claim 1, wherein: said tray further comprises a triangular assembly of a mounting plate, a face plate and a base.

3. An adjustable socket tray according to claim 1, wherein: said plurality of movable partitions are slidingly attached to a rest for supporting said sockets.

4. An adjustable socket tray according to claim 1, wherein: said means for detecting the presence of said sockets further comprises a microswitch.

5. An adjustable socket tray according to claim 1, wherein: said means for detecting a condition response in response to the detected presence of said sockets further comprises a controller.

6. An adjustable socket tray according to claim 5, wherein: said controller is a programmable computer.

7. An adjustable socket tray according to claim 6, wherein: said programmable computer is provided with an instructional display.

8. An adjustable socket tray according to claim 5, wherein: said controller effects a pre-selected drive condition for a selected socket.

9. An adjustable socket tray according to claim 8, wherein: said controller effects a pre-selected torque to be supplied to an identified fastener.

* * * * *